US007903035B2

(12) United States Patent
Mikkola et al.

(10) Patent No.: US 7,903,035 B2
(45) Date of Patent: Mar. 8, 2011

(54) INTERNAL ANTENNA AND METHODS

(75) Inventors: Jyrki Mikkola, Evijärvi (FI); Ari Raappana, Kello (FI); Pasi Keskitalo, Oulu (FI); Pertti Nissinen, Kempele (FI)

(73) Assignee: Pulse Finland OY, Kempele (FI)

( * ) Notice: Subject to any disclaimer, the term of this patent is extended or adjusted under 35 U.S.C. 154(b) by 68 days.

(21) Appl. No.: 12/082,514

(22) Filed: Apr. 11, 2008

(65) Prior Publication Data

US 2009/0140942 A1 Jun. 4, 2009

Related U.S. Application Data

(63) Continuation of application No. PCT/FI2006/050407, filed on Sep. 25, 2006.

(51) Int. Cl.
*H01Q 1/24* (2006.01)

(52) U.S. Cl. ..... 343/702; 343/700 MS; 343/846

(58) Field of Classification Search ..... 343/702, 343/845, 846, 825, 829, 700 MS
See application file for complete search history.

(56) References Cited

U.S. PATENT DOCUMENTS

| | | | | |
|---|---|---|---|---|
| 4,069,483 | A | 1/1978 | Kaloi | |
| 5,278,528 | A | 1/1994 | Turunen | |
| 5,382,959 | A | 1/1995 | Pett et al. | |
| 5,432,489 | A | 7/1995 | Yrjola | |
| 5,557,292 | A | 9/1996 | Nygren et al. | |
| 5,764,190 | A | 6/1998 | Murch et al. | |
| 5,892,490 | A | 4/1999 | Asakura et al. | |
| 5,905,475 | A | 5/1999 | Annamaa | |
| 6,016,130 | A | 1/2000 | Annamaa | |
| 6,097,345 | A | 8/2000 | Walton | |
| 6,133,879 | A | 10/2000 | Grangeat et al. | |
| 6,140,973 | A | 10/2000 | Annamaa | |
| 6,147,650 | A | 11/2000 | Kawahata et al. | |
| 6,177,908 | B1 | 1/2001 | Kawahata | |
| 6,185,434 | B1 | 2/2001 | Hagstrom | |
| 6,195,049 | B1 | 2/2001 | Kim et al. | |
| 6,246,368 | B1 | 6/2001 | Deming et al. | |
| 6,252,554 | B1 | 6/2001 | Isohatala | |
| 6,268,831 | B1 * | 7/2001 | Sanford | 343/702 |
| 6,323,811 | B1 | 11/2001 | Tsubaki | |

(Continued)

FOREIGN PATENT DOCUMENTS

DE 101 50 149 A1 4/2003

(Continued)

OTHER PUBLICATIONS

U.S. Appl. No. 11/883,945, filed Jun. 23, 2008, Ari Raappana.

(Continued)

*Primary Examiner* — Hoang V Nguyen
(74) *Attorney, Agent, or Firm* — Gazdzinski & Associates, PC

(57) ABSTRACT

An internal antenna especially aimed at flat radio devices. The antenna (200) comprises a planar radiator (220) with a branch (221) for forming a lower operating band for the antenna and a second branch (222) for forming an upper operating band. The branches typically form a frame-like pattern. There remains a slot (230) between the branches, opening to the outer edge of the radiator approximately in the middle of the edge running in the direction of the end of the circuit board (205) and being outside the circuit board as seen from above. The omnidirectional radiation of the antenna on its upper operating band improves as compared to the corresponding, known antennas, and its efficiency improves, because the average antenna gain increases.

53 Claims, 4 Drawing Sheets

U.S. PATENT DOCUMENTS

| | | | | |
|---|---|---|---|---|
| 6,326,921 | B1 * | 12/2001 | Egorov et al. | 343/700 MS |
| 6,404,394 | B1 | 6/2002 | Hill | |
| 6,456,249 | B1 | 9/2002 | Johnson et al. | |
| 6,535,170 | B2 * | 3/2003 | Sawamura et al. | 343/702 |
| 6,549,167 | B1 | 4/2003 | Yoon | |
| 6,580,396 | B2 * | 6/2003 | Lin | 343/700 MS |
| 6,614,400 | B2 | 9/2003 | Egorov | |
| 6,650,295 | B2 | 11/2003 | Ollikainen et al. | |
| 6,683,573 | B2 | 1/2004 | Park | |
| 6,781,545 | B2 | 8/2004 | Sung | |
| 6,847,329 | B2 * | 1/2005 | Ikegaya et al. | 343/702 |
| 6,876,329 | B2 | 4/2005 | Milosavljevic | |
| 7,042,403 | B2 * | 5/2006 | Colburn et al. | 343/702 |
| 7,057,560 | B2 | 6/2006 | Erkocevic | |
| 7,081,857 | B2 * | 7/2006 | Kinnunen et al. | 343/702 |
| 7,136,019 | B2 * | 11/2006 | Mikkola et al. | 343/702 |
| 7,148,849 | B2 | 12/2006 | Lin | |
| 7,148,851 | B2 | 12/2006 | Takaki et al. | |
| 7,180,455 | B2 | 2/2007 | Oh et al. | |
| 7,205,942 | B2 | 4/2007 | Wang et al. | |
| 7,218,282 | B2 | 5/2007 | Humpfer et al. | |
| 7,224,313 | B2 | 5/2007 | McKinzie, III et al. | |
| 7,274,334 | B2 | 9/2007 | O'Riordan et al. | |
| 7,289,064 | B2 | 10/2007 | Cheng | |
| 7,330,153 | B2 | 2/2008 | Rentz | |
| 7,333,067 | B2 | 2/2008 | Hung et al. | |
| 7,339,528 | B2 | 3/2008 | Wang et al. | |
| 7,340,286 | B2 | 3/2008 | Korva | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,385,556 | B2 * | 6/2008 | Chung et al. | 343/700 MS |
| 7,417,588 | B2 * | 8/2008 | Castany et al. | 343/700 MS |
| 7,423,592 | B2 * | 9/2008 | Pros et al. | 343/700 MS |
| 7,439,929 | B2 * | 10/2008 | Ozkar | 343/846 |
| 2002/0019247 | A1 | 2/2002 | Egorov | |
| 2002/0145569 | A1 | 10/2002 | Onaka | |
| 2002/0163470 | A1 | 11/2002 | Nagumo et al. | |
| 2002/0196192 | A1 | 12/2002 | Nagumo | |
| 2003/0020659 | A1 | 1/2003 | Kushihi | |
| 2003/0092420 | A1 | 5/2003 | Sugimoto et al. | |
| 2004/0080457 | A1 | 4/2004 | Guo et al. | |
| 2004/0090366 | A1 | 5/2004 | Wong et al. | |
| 2004/0090378 | A1 | 5/2004 | Dai et al. | |
| 2004/0090382 | A1 | 5/2004 | Kushihi et al. | |
| 2004/0130493 | A1 * | 7/2004 | Horita et al. | 343/702 |
| 2004/0178957 | A1 | 9/2004 | Chang et al. | |
| 2005/0024268 | A1 | 2/2005 | McKinzie, III et al. | |
| 2005/0024272 | A1 | 2/2005 | Ponce De Leon et al. | |
| 2005/0057401 | A1 | 3/2005 | Yuanzhu | |
| 2005/0057416 | A1 | 3/2005 | Yuanzhu | |
| 2005/0078037 | A1 | 4/2005 | Leclerc et al. | |
| 2005/0110692 | A1 * | 5/2005 | Andersson | 343/702 |
| 2005/0243001 | A1 | 11/2005 | Miyata et al. | |
| 2006/0071857 | A1 | 4/2006 | Pelzer | |
| 2006/0145924 | A1 | 7/2006 | Chen et al. | |
| 2006/0214857 | A1 | 9/2006 | Ollikainen | |
| 2007/0109202 | A1 | 5/2007 | Vance | |
| 2007/0115177 | A1 | 5/2007 | Kawahata | |
| 2007/0139277 | A1 | 6/2007 | Nissinen | |
| 2007/0152885 | A1 | 7/2007 | Sorvala | |
| 2007/0152887 | A1 * | 7/2007 | Castany et al. | 343/702 |
| 2007/0171131 | A1 | 7/2007 | Sorvala | |
| 2007/0268190 | A1 | 11/2007 | Huynh | |
| 2007/0290938 | A1 | 12/2007 | Loyet | |
| 2008/0007459 | A1 | 1/2008 | Koskiniemi et al. | |
| 2008/0042903 | A1 | 2/2008 | Cheng | |
| 2008/0088511 | A1 | 4/2008 | Sorvala | |
| 2008/0204328 | A1 | 8/2008 | Nissinen | |
| 2008/0284661 | A1 | 11/2008 | He | |
| 2008/0316116 | A1 | 12/2008 | Hobson et al. | |

FOREIGN PATENT DOCUMENTS

| | | | |
|---|---|---|---|
| EP | 0 332 139 | | 9/1989 |
| EP | 0 376 643 | | 4/1990 |
| EP | 0 766 340 | | 4/1997 |
| EP | 0 831 547 | A2 | 3/1998 |
| EP | 1 294 048 | | 1/1999 |
| EP | 1 003 240 | A2 | 5/2000 |
| EP | 1 052 723 | | 11/2000 |
| EP | 1 063 722 | A2 | 12/2000 |
| EP | 1 102 348 | | 5/2001 |
| EP | 1 113 524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1 248 316 | | 9/2002 |
| EP | 1 267 441 | | 12/2002 |
| EP | 1 351 334 | | 8/2003 |
| EP | 1 361 623 | | 11/2003 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1 453 137 | | 9/2004 |
| EP | 1 469 549 | | 10/2004 |
| EP | 1 498 984 | | 1/2005 |
| EP | 1 544 943 | | 6/2005 |
| EP | 1 791 213 | | 5/2007 |
| JP | 10 028013 | | 1/1998 |
| JP | 10 209733 | | 8/1998 |
| JP | 11 068456 | | 3/1999 |
| JP | 2002319811 | A | 10/2002 |
| JP | 2004112028 | | 4/2004 |
| JP | 2004363859 | | 12/2004 |
| JP | 2005005985 | | 1/2005 |
| JP | 2005252661 | | 9/2005 |
| KR | 10-2006-7027462 | | 12/2002 |
| WO | WO 98/37592 | | 8/1998 |
| WO | WO 00/36700 | | 6/2000 |
| WO | WO 01/28035 | | 4/2001 |
| WO | WO 01/33665 | | 5/2001 |
| WO | WO 02/11236 | A1 | 2/2002 |
| WO | WO 02/078123 | | 10/2002 |
| WO | WO 2004/070872 | | 8/2004 |
| WO | WO 2004/100313 | | 11/2004 |
| WO | WO 2004/112189 | A | 12/2004 |
| WO | WO 2005/018045 | | 2/2005 |
| WO | WO 2005011055 | | 2/2005 |
| WO | WO 2005/038981 | A1 | 4/2005 |
| WO | WO 2005038981 | | 4/2005 |
| WO | WO 2005/055364 | | 6/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/138157 | | 12/2007 |

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

Product of the Month, RFDesign, "GSM/GPRS Quad Band Power Amp Includes Antenna Switch," 1 page, reprinted Nov. 2004 issue of RF Design (www.rfdesion.com), Copyright 2004, Freescale Semiconductor, RFD-24-EK.

Wong, K., et al.; "A Low-Profile Planar Monopole Antenna for Multiband Operation of Mobile Handsets"; IEEE Transactions on Antennas and Propagation, Jan. 2003, vol. 51, No. 1.

Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

O. Kivekäs, et al.; "Frequency-tunable internal antenna for mobile phones", Proceedings of 12èmes Journées Internationales de Nice sur les Antennes, 12th Int'l Symposium on Antennas (JINA 2002), vol. 2, 2002, Nice, France, s.53-56, tiivistelmä.

"A 13.56MHz RFID Device and Software for Mobile Systems", by H. Ryoson, et al., Micro Systems Network Co., 2004 IEEE, pp. 241-244.

* cited by examiner

INTERNAL ANTENNA AND METHODS

PRIORITY AND RELATED APPLICATIONS

This application is a continuation of prior International PCT Application No. PCT/FI2006/050407 having an international filing date of Sep. 25, 2006, which claims priority to Finland Patent Application No. 20055545 filed Oct. 10, 2005, each of the foregoing incorporated herein by reference in their entireties. This application is related to co-owned and co-pending U.S. patent application Ser. No. 12/080,741 filed Apr. 3, 2008 and entitled "Multiband Antenna System And Methods", This application is related to co-owned and co-pending U.S. patent application Ser. Nos. 12/083,129 filed Apr. 3, 2008 and entitled "Multiband Antenna System And Methods", 12/009,009 filed Jan. 15, 2008 and entitled "Dual Antenna Apparatus And Methods", 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. Nos. 11/648,429 filed Dec. 28, 2006 and entitled "Antenna, Component And Methods", and 11/648,431 also filed Dec. 28, 2006 and entitled "Chip Antenna Apparatus and Methods", both of which are incorporated herein by reference in their entirety. This application is further related to U.S. patent application Ser. Nos. 11/901,611 filed Sep. 17, 2007 entitled "Antenna Component and Methods", 11/883,945 filed Aug. 6, 2007 entitled "Internal Monopole Antenna", 11/801,894 filed May 10, 2007 entitled "Antenna Component", and 11/922,976 entitled "Internal multiband antenna and methods" filed Dec. 28, 2007, each of the foregoing incorporated by reference herein in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to an internal antenna of a radio device. The antenna is aimed especially at small and flat radio devices with several operating bands.

An ideal antenna in portable radio devices would be one that transmits and receives equally in all directions. In practice, there is substantial variation in the efficiency of transmitting and receiving depending on the direction. In mobile stations, this drawback is reduced by the fact that the propagation of the radio transmitting signal is of multipath type caused by the environment, whereby the same transmitting signal arrives at the antenna from many directions, and in most cases at least one of the partial transmitting signals arrives in an advantageous direction with regard to receiving. Correspondingly, the part of the transmitting signal of the mobile station, which momentarily takes off to an advantageous direction, propagates to the base station antenna. Therefore, the transfer of speech and text messages generally succeeds without problems. The situation is different when the mobile station is used for Internet connections having a relatively high speed, because the probability of bit errors is then higher. If the antenna had an omni-directional pattern, the reliability of the transfer would improve substantially. An omni-directional pattern would also be advantageous when the transmitting signal comes mainly from one direction only, like in GPS (Global Positioning System) receiving.

Of the antenna types, a whip antenna outside the cover of the radio device has a high quality in the above mentioned respect. In theory, its directional pattern has a circular shape in the plane perpendicular to the axis of the whip. However, external antennas are vulnerable to damage, and with the additional parts required by them they increase the manufacturing costs significantly. Therefore, most models of mobile stations have turned to internal antennas.

But when the size of mobile stations has decreased, the space available for the internal antenna has also become smaller and smaller. This means that design becomes more demanding. The space available especially in the vertical direction is naturally the smaller the flatter the device is. Structural parts that are flatter than usual are, for example, the parts of such a two-part radio device, which are either on top of each other or one after the other as extensions of each other, depending on the situation of use. In these cases, the antenna generally used is of the monopole type, which does not require as much space in the vertical direction as the planar antenna of the PIFA type (Planar Inverted F-Antenna), which is otherwise used commonly.

FIG. 1 shows an example of a known internal antenna of a device. A part of the circuit board 105 of the radio device is seen in the drawing. The circuit board has sides and perpendicular ends thereof. The radiator 120 of the antenna is of the monopole type. It has the shape of a planar and elongated rectangle. The longitudinal direction of the rectangle is the same as the direction of the end of the circuit board. The radiator is fastened to one end of the circuit board so that it is approximately in the same plane with the circuit board and is for the most part located on the side of the circuit board as seen from above. A continuous ground plane 110, or signal ground GND, is located on the circuit board at a certain distance from the radiator 120. As seen from its feed point FP, the radiator is divided into two branches of different length for forming two separate operating bands. The shorter branch 122 is L-shaped. When starting from the feed point, it has first a short portion in the direction of the sides of the circuit board 105 and then a longer portion in the direction of the end of the circuit board. The longer branch 121 is U-shaped. When starting from the feed point FP, it has a first portion running beside the shorter branch in the direction of the end of the circuit board, then a second portion in the direction of the sides of the circuit board, and finally a third portion in the direction of the end of the circuit board on the other side of the shorter branch. The third portion extends abreast of the feed point FP as seen in the direction of the side of the feed point. The lower one of the operating bands is based on the longer branch of the radiator and the upper one on the shorter branch.

When the antenna is wanted to have at least two bands, the radiator must be shaped in a way that it is provided with (a) slot(s) directed inward from its outline. In the example of FIG. 1, such a slot 130 is near the corner of the radiator 120, between the tail of the longer branch 121 and the corner point of the shorter branch 122. As a drawback, the directional pattern of the antenna has in this case a minimum point at the frequencies of the upper operating band, which minimum point is in the plane of the radiator in its longitudinal direction on the side of the slot. When the antenna is in the upright position so that the ground plane of the radio device remains below it, the minimum point occurs in the directional pattern of the horizontal plane. Naturally, the directional pattern has variation also at the frequencies of the lower operating band, but it is not dealt with in this description.

SUMMARY OF THE INVENTION

In a first aspect of the present invention, an internal antenna of a radio device is disclosed. In one embodiment, the internal antenna comprises a planar radiator with a branch for forming a lower operating band for the antenna and a second branch for forming an upper operating band. The branches typically form a frame-like pattern. There remains a slot between the branches, opening to the outer edge of the radiator approximately in the middle of the edge running in the direction of the end of the circuit board and being outside the circuit board as seen from above.

The invention has the advantage that the omnidirectional radiation of the internal antenna in its upper operating band improves in the horizontal plane when the radiator is in the upright position so that the ground plane of the radio device remains below it. This is due to the location of the slot between the branches of the radiator as described above. Radiation is then emitted more equally in both directions in the direction of the edge at issue. In addition, the invention has the advantage that the efficiency of the internal antenna improves, because the average antenna gain increases.

In a second aspect of the invention, antenna apparatus useful in a radio device is disclosed. In one embodiment, the radio device comprising a substrate having a ground plane thereon, the antenna comprising: a feed point; a substantially planar monopole radiator comprising a first branch for a lower operating band of the antenna and a second branch for an upper operating band of the antenna; and a slot opening to an outer edge of the substantially planar monopole radiator, the slot opening being disposed in a generally centralized area of the radiator, the slot residing substantially between the first and second branches.

In one variant, the outer edge is disposed substantially parallel with an end of the substrate.

In another variant, the apparatus further comprise a tuning branch.

In yet another variant, the first and second branches define a generally rectangular outer perimeter and a central aperture.

In still another variant, at least one of the first and second branches protrudes into the central aperture forming a branch protrusion. The branch protrusion comprises e.g., a generally L-shaped branch section.

In another variant, the slot opening disposed in the generally centralized area improves the omnidirectional radiation characteristics of the antenna apparatus in at least one operating band.

In a further variant, the generally centralized area comprises a 40 percent middle portion of the outer edge.

In yet another variant, the outer edge comprises a first and a second section at least partly demarcated by the slot opening, the first and second sections being substantially collinear with respect to one another.

Alternatively, the outer edge may comprise a first and a second section at least partly demarcated by the slot opening, the first and second sections being substantially parallel, yet non-collinear, with respect to one another.

In another variant, the feed point is disposed generally at a region of intersection of the first and second branches.

In yet a further variant, the feed point is disposed proximate a region of intersection of the first and second branches.

In still a further variant, the first and second branches comprise differing lengths with respect to one another, the differing lengths corresponding to differing operating bands for the antenna apparatus.

In a third aspect of the invention, a portable radio device comprising an omnidirectional planar monopole antenna is disclosed. In one embodiment, the radio device further comprises: a processor adapted to process received electromagnetic signals; a substrate comprising a ground plane, the substrate further adapted to electrically couple the processor with the omnidirectional planar monopole antenna. The omnidirectional planar monopole antenna comprises: a feed point; a planar monopole radiator comprising a first branch for a lower operating band of the antenna and a second branch for an upper operating band of the antenna; and a slot opening to an outer edge of the planar monopole radiator in a generally centralized area of the planar monopole radiator, the slot residing substantially between the first and second branches. The outer edge is disposed substantially parallel with an end of the substrate.

In one variant, the processor comprises a microprocessor adapted for global positioning system applications.

In another variant, the ground plane resides outside of the footprint of the omnidirectional planar monopole antenna. The outer edge of the planar monopole radiator is located e.g., outside of the substrate outer edge when viewed from above.

In yet another variant, the first and second branches define a generally rectangular outer perimeter and a central aperture. For example, in one configuration, at least one of the first and second branches protrudes into the central aperture forming a branch protrusion.

In another variant, the generally centralized area comprises a central 40 percent portion of the outer edge.

In still a further variant, the first and second branches comprise differing lengths with respect to one another, the differing lengths corresponding to differing operating bands for the antenna apparatus.

In a fourth aspect of the invention, an internal antenna of a radio device is disclosed. In one embodiment, the radio device has a circuit board provided with a ground plane, the antenna comprising: a planar monopole radiator, which is divided, as seen from a feed point of the antenna, into a first branch to form a lower operating band for the antenna, and a second branch to form an upper operating band for the antenna, wherein between the branches there remains a slot opening to an outer edge of the radiator. The outer edge is the edge of the radiator running substantially in the direction of an end of the circuit board and outside the circuit board as seen from above, and wherein the slot opens to the outer edge in its central area to improve the omnidirectional radiation of the antenna on its upper operating band.

In one variant, the radiator is located substantially in the same geometrical plane as the circuit board of the radio device.

In another variant, the radiator is elevated from the circuit board of the radio device, partly on top of the ground plane.

In yet a further variant, the radiator is located at least partly on top of the ground plane.

In another variant, the radiator further comprises a radiating parasitic element located at least partly below the radiator and connected at one point thereof to the ground plane of at least one of the radio device or the signal ground.

In still a further variant, the first branch has an end portion located in a central area of the radiator proximate the free end of the second branch so as to set the operating bands at the desired places in the frequency scale.

In yet a further variant, the radiator comprises a strip of metal sheet, and the slot opens to the outer edge of the radiator substantially perpendicularly to the end of the circuit board.

In another variant, the slot opens to the outer edge of the radiator in the direction of the end of the circuit board.

In a fifth aspect of the invention, an internal antenna for use in a radio device is disclosed. In one embodiment, the antenna comprises: a substantially planar radiator comprising a first branch for forming a lower operating band for the antenna and a second branch for forming an upper operating band; and a slot formed at least partly between the branches, opening to the outer edge of the radiator. Radiation from the antenna in the upper band is substantially omnidirectional in the horizontal plane when the radiator is in an upright position with respect to the horizontal plane so that a ground plane of the radio device remains below the horizontal plane.

In a sixth aspect of the invention, a high-efficiency internal antenna for use in a radio device is disclosed. In one embodiment the antenna comprises: a substantially planar radiator comprising a first branch for forming a lower operating band for the antenna and a second branch for forming an upper operating band; and a slot formed at least partly between the branches, opening to the outer edge of the radiator. Radiation from the antenna in the upper band is substantially equal within a dimension, the dimension being oriented in the direction of the outer edge.

In one variant, the high efficiency results at least from an average antenna gain increase over a gain otherwise achievable with other antenna configurations not having the first branch, the second branch, and the slot.

DETAILED DESCRIPTION OF THE INVENTION

Reference is now made to the drawings wherein like numerals refer to like parts throughout.

Figure 1:
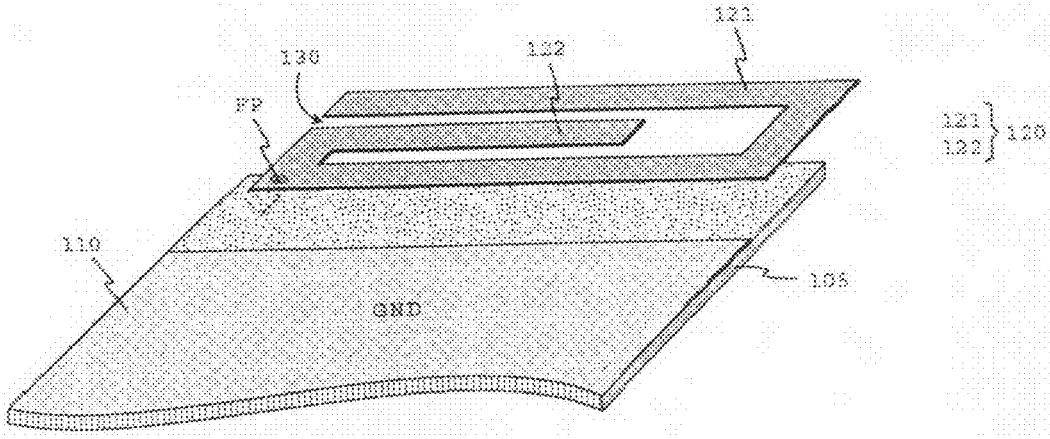
Fig. 1 PRIOR ART
FIG. 1 shows an example of a prior art internal antenna of a radio device.

FIG. 1 was described in connection with the description of the prior art.

Figure 2:
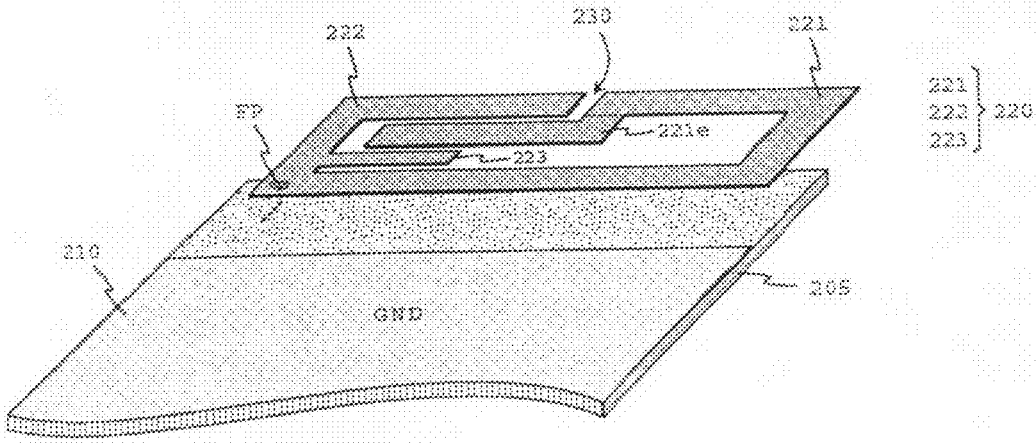
FIG. 2 shows an example of an internal antenna of a radio device according to the invention.

FIG. 2 displays an example of an antenna according to the invention, internal to a radio device. A part of the circuit board 205 of the radio device and the monopole-type radiator 220 of the antenna are seen in the drawing. As in FIG. 1, it is plane-like and elongated rectangle by outline, the longitudinal direction of which is the same as the direction of the end of the circuit board. The radiator is attached to the end of the circuit board so that it is approximately in the same plane with the circuit board and for the most part located outside the circuit board as viewed from above. There is a continuous ground plane 210, or signal ground GND, on the circuit board at a certain distance from the radiator 220. Again, like in FIG. 1, the radiator is divided into two branches of different length, as viewed from its feed point FP, for forming two separate operating bands. The feed point is in one of the two corners of the radiator, which are on top of the circuit board. The shaping of the branches differs from that shown in FIG. 1. When starting from the feed point, the second, shorter branch 222 has first a portion directed outward from the end of the circuit board 205, forming one end of the radiator, and then a second portion running in the direction of the end of the circuit board, which forms about half of the outer long side of the radiator. When starting from the feed point, the first, longer branch 221 has a first portion running in the direction of the end of the circuit board, forming the long side of the radiator closer to the circuit board, and then a second portion perpendicular to the former, which forms the second end of the radiator. After this, the first branch has a third portion running in the direction of the end of the circuit board, which forms a part of the outer, long side of the radiator. The third portion extends to a point near the free end of the second branch 222 so that a relatively narrow slot 230 remains between them. In this example, the first branch 221 further makes a bend to the inner area of the radiator, and continues beside the second portion of the second branch towards the end of the radiator on the side of the feed point, forming the end portion 221*e* of the first branch. The slot 230 continues between the end portion and the second portion of the second branch 222. The coupling over the slot increases the electric length of both branches, in which case the width of the slot and the length of the end portion 221*e* can be used as parameters for setting the operating bands of the antenna in place. For the same purpose, the radiator has a tuning strip 223 starting near the feed point FP and extending between the first portion and the end portion of the first branch.

According to what is described above, the slot 230 opens to the edge of the radiator approximately in the middle of the outer side running in the direction of the end of the circuit board. As a result of this, the shape of the near field of the antenna at the frequencies of the upper operating band becomes such that the structure radiates relatively equally in both directions in the longitudinal direction of the radiator. This belongs to the horizontal plane when the radio device and its antenna are in an upright position so that the ground plane on the circuit board of the device is below the antenna.

Figure 3:
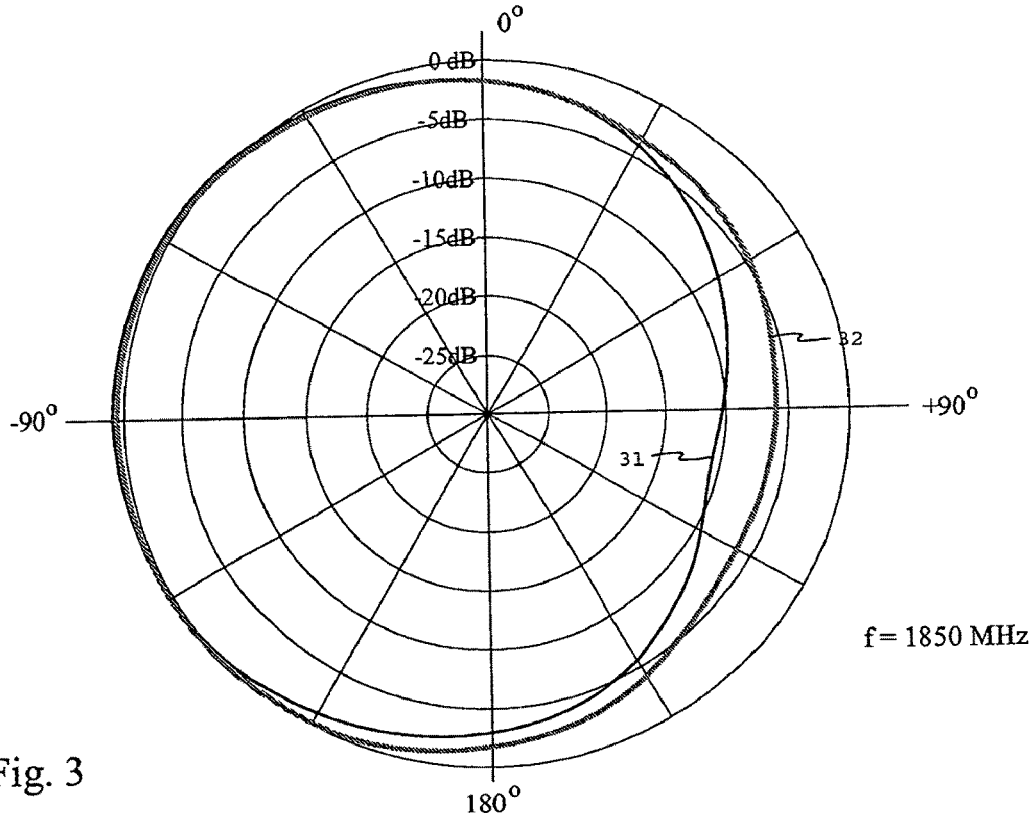
FIG. 3 shows an example of the effect of the invention on the directional characteristics of the antenna.
Figure 4:
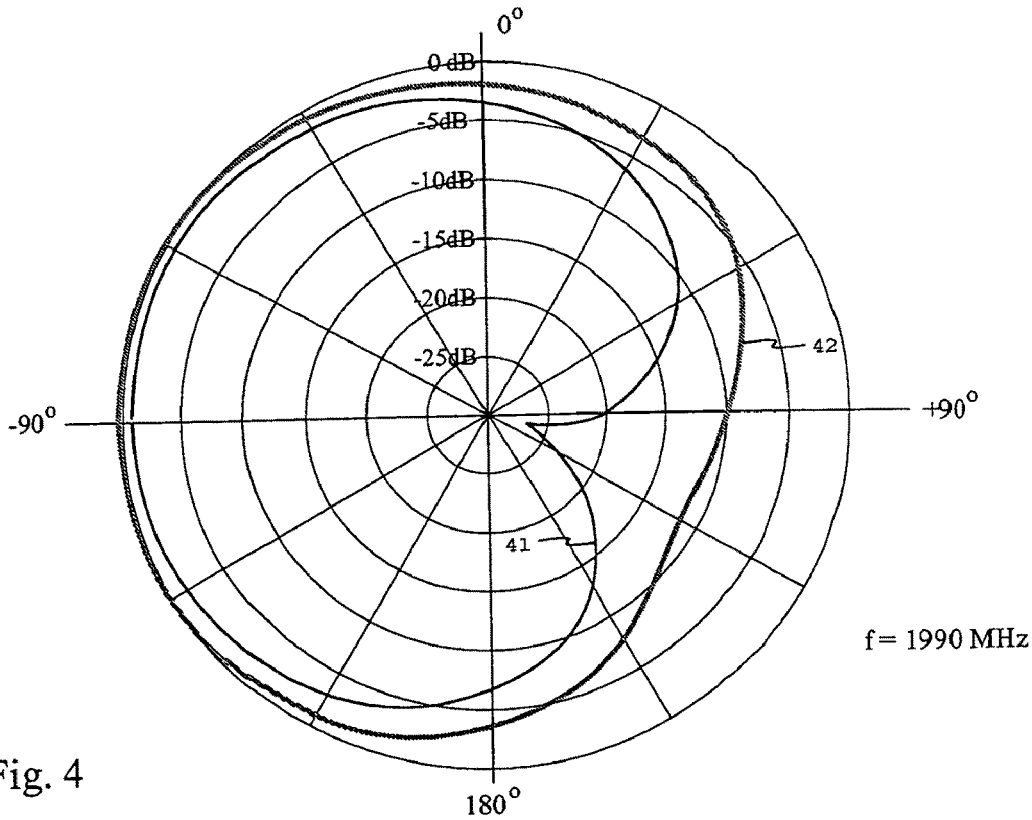
FIG. 4 shows another example of the effect of the invention on the directional characteristics of the antenna.

FIGS. 3 and 4 show an example of the effect of the invention on the directional characteristics of the antenna in the upper operating band. The curves display the horizontal directional pattern, i.e. the antenna gain, as a function of the directional angle when the device is in the upright position as described above. Curve 31 in FIG. 3 and curve 41 in FIG. 4 concern a prior art antenna according to FIG. 1, and curve 32 in FIG. 3 and curve 42 in FIG. 4 concern an antenna according to the invention shown in FIG. 2. The antennas are designed so that their upper operating band covers the frequency range 1850-1990 MHz used by GSM1900 (Global System for Mobile telecommunications). The directional patterns of FIG. 3 have been measured at the lower boundary frequency of this range, and the directional patters of FIG. 4 at the upper boundary frequency of this range.

It is seen from FIG. 3 that the gain of the known antenna on the lower boundary of the operating band is about −11 dB in the most adverse direction. The corresponding gain of an antenna according to the invention is approximately −6½ dB, i.e. approximately 4½ dB higher. In addition, the gain is at least 1 dB higher in an area of approximately 180 degrees. It is seen from FIG. 4 that the gain of the known antenna on the upper boundary of the operating band is about −27 dB in the most adverse direction, which is zero gain in practice. The corresponding gain of an antenna according to the invention is approximately −11½ dB, i.e. approximately 15 dB higher. In addition, a gain at least 3 dB higher is achieved in an area of approximately 150 degrees, and a gain at least 1 dB higher is achieved in all directions of the horizontal plane. The deep minimum points in the directional patterns of the known antennas are entirely avoided when the antenna according to the invention is used.

Figure 5:
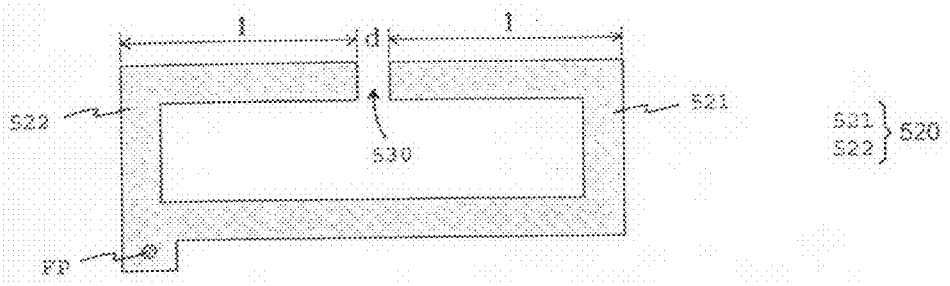
FIG. 5 shows another example of an internal antenna of a radio device according to the invention.

FIG. 5 presents another example of an antenna according to the invention, internal to a radio device. Only the radiator 520 is shown in the drawing. Its structure is slightly simpler than in FIG. 2. The first 521 and the second 522 branch of the radiator now form a mere rectangular frame, in which a slot 530 remains between the ends of the branches. The portions of the branches, which are on the long side of the radiator where the slot 530 is, are equally long in this example, and so the slot is located just in the middle of that side. The width d of the slot is not a critical parameter with regard to omnidirectional radiation; it can be in the range of 0.5-5 mm, for example. In this example, the feed point FP of the radiator, from which the branches 521, 522 start, is in a small projection of the radiator, which extends from the frame to the circuit board of the radio device.

More generally, in the antennas according to the invention, the slot may start in the central area of the edge running in the direction of the end of the circuit board on either side of the mid-point. In this description and the claims, the "central area" means an area at a distance of (0.3-0.7)s from the end of the edge, where s is the length of the edge.

Figure 6:
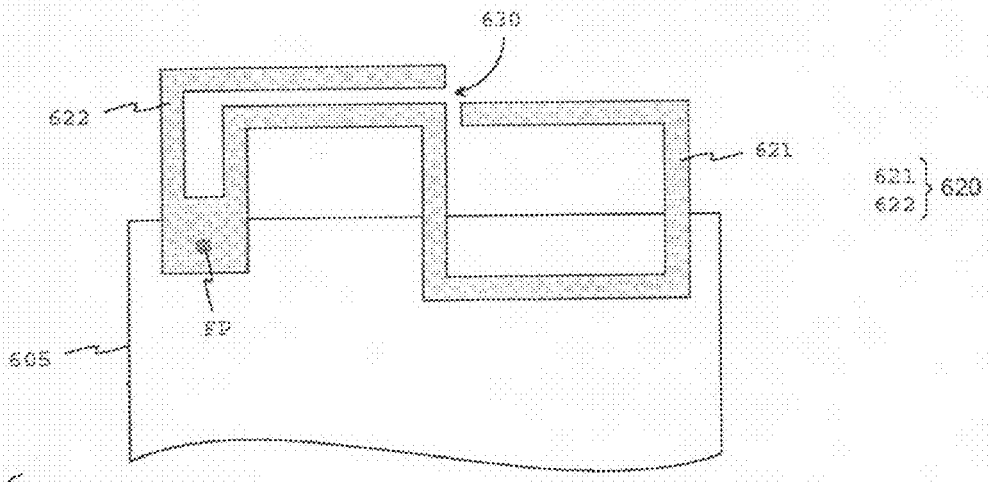
FIG. 6 shows a third example of an internal antenna of a radio device according to the invention.

FIG. 6 shows a third example of an antenna according to the invention, internal to the radio device. The radiator 620 and the end of a circuit board 605 are seen in the drawing. When starting from the feed point FP, the second branch 622 of the radiator has a first portion directed outward from the end of the circuit board, forming one end of the radiator, and then a second portion in the direction of the end of the circuit board, which forms a little over half of the outer long side of the radiator in this example. When starting from the feed point FP, the first branch 621 of the radiator has a first portion running in the direction of the first portion of the second branch and shorter than it, a second portion running in the direction of the second portion of the second branch and extending to its end, then a third portion directed toward the circuit board 605, a fourth portion directed away from the feed point in the direction of the end of the circuit board, a fifth portion directed outward from the end of the circuit board and forming the second end of the radiator, and a sixth portion running again in the direction of the end of the circuit board and ending near the point where the second portion of the first branch changes to the third portion. A relatively narrow slot 630, opening in the central area of the radiator, remains between the second portion of the first branch and the second portion of the second branch. In this example, the slot opens to the outer edge in the direction of the end of the circuit board, because the sixth portion of the first branch is directed towards the end of its second portion and not towards the end of the second portion of the second branch.

Figure 7:
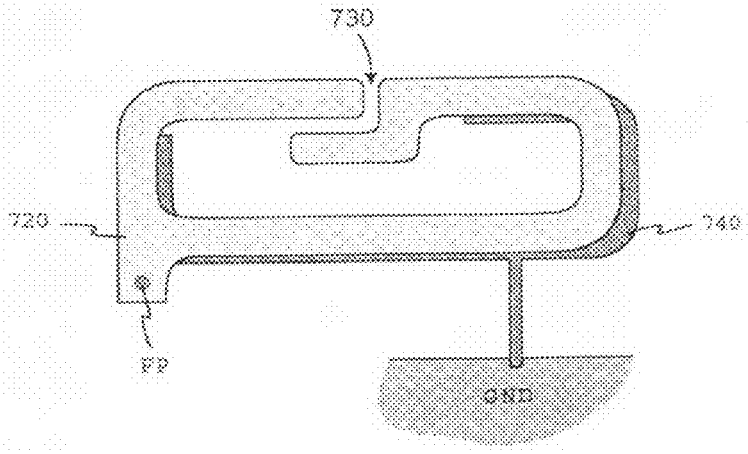
FIG. 7 shows a fourth example of an internal antenna of a radio device according to the invention.

FIG. 7 shows a fourth example of an antenna according to the invention, internal to the radio device. It shows the main radiator 720 of the antenna, which is similar in principle as the radiator 220 in FIG. 2, but without the tuning strip 223. The frame formed by the main radiator is also strongly rounded at the corners, except for the corner of the feed point FP. In addition, the antenna now includes a radiating parasitic element 740, which is located under the radiator and is connected at one point to the signal ground GND of the radio device. The shape of the parasitic element follows the branches of the main radiator, but it does not extend near the slot 730 of the main radiator so as not to interfere with the operation according to the invention.

Figure 8:
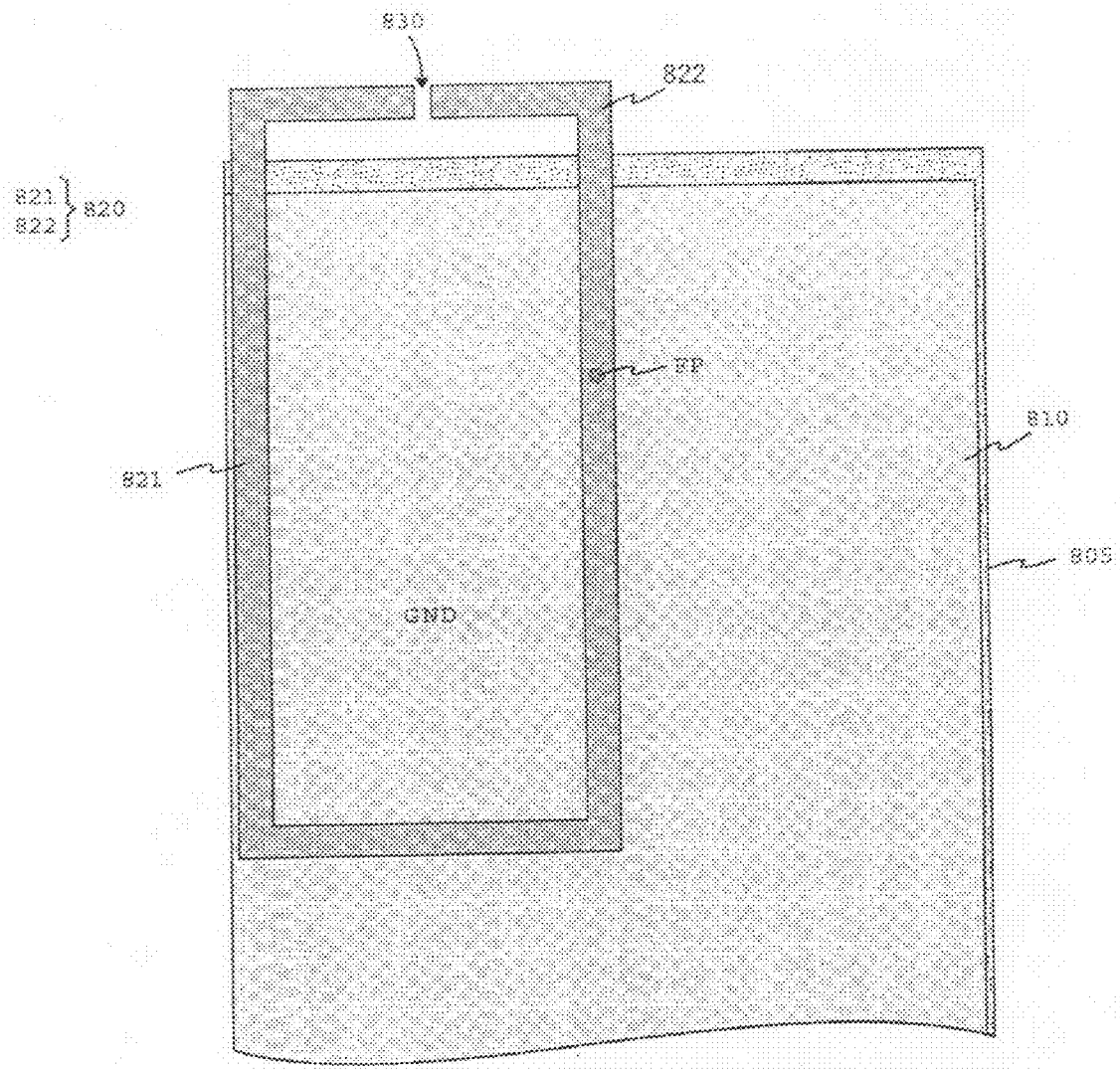
FIG. 8 shows a fifth example of an internal antenna of a radio device according to the invention.

FIG. 8 presents a fifth example of an antenna according to the invention, internal to the radio device. Part of the circuit board 805 of a radio device and the radiator 820 of the antenna are seen in the figure. The radiator forms a rectangular frame, where the longitudinal direction in this case is the same as the longitudinal direction of the circuit board, or the direction of the sides. As seen from above, the second, or outer end of the radiator frame and a small part of the longer sides are outside the circuit board at its end. Therefore, the radiator in this example is mostly on top of the circuit board and the ground plane 810 on it, naturally separated from the ground plane. In this case, too, as seen from the feed point FP, the radiator 820 is divided into two branches of different length for forming two separate operating bands. The feed point is on one of the longer sides of the radiator, and the slot 830 between the ends of the branches in the middle of the outer end of the radiator. The second, shorter branch 822 of the radiator is then formed of the part reaching from the feed point FP of the longer side of the radiator to the outer end and a half of the outer end. Correspondingly, the first, longer branch 821 is formed of a portion reaching from the feed point of the longer side of the radiator to the opposite end, the opposite end, the opposite longer side and the other half of the outer end.

Figure 9:
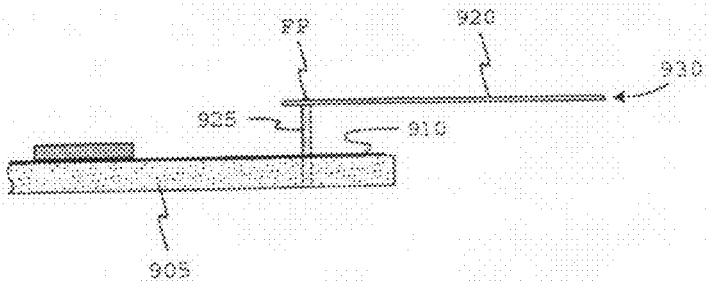
FIG. 9 shows an example of the location of the radiator in the antenna according to the invention.

FIG. 9 shows an example of the location of the radiator in the antenna according to the invention. Part of the circuit board 905 of a radio device and the radiator 920 of the antenna are seen from the side in the drawing. The radiator of this example is elevated from the circuit board, like the radiator in FIG. 8. In this case, the radiator is mostly outside the circuit board, as seen from above, but a significant part of it is also on top of the ground plane 910 on the circuit board. The radiator is connected from its feed point FP to the antenna port on the circuit board by a feed conductor 925. The slot 930 between the branches of the radiator is on its outer side as seen from the circuit board. Naturally, the radiator needs a dielectric support structure, which is not shown in the drawing.

The qualifiers "from above", on top of" and "below" in the claims refer to the position of the radio device, in which the circuit board of the radio device and the radiator of the antenna are horizontal in a way that the feed point of the radiator is on the side of the upper surface of the circuit board. Naturally, the antenna can be in any position when used.

An internal antenna according to the invention has been described above. Its implementation may differ from that described in its details. For example, the slot in the radiator conductor of the antenna can be shaped in a way that it functions as a significant auxiliary radiator on the upper operating band. A short-circuit conductor may also be connected to the radiator for matching it. For example, in the structure shown by FIG. 2, such a conductor may extend from the edge of the radiator on the circuit board to the ground plane. The invention does not limit the manufacturing method of the antenna. For example, the radiator(s) may be made of relatively rigid strips of metal sheet, or of the conductor coating of the circuit board. The inventive idea can be applied in different ways within the scope defined by the independent claim 1.

The invention claimed is:

1. An internal antenna of a radio device, the radio device having a circuit board provided with a ground plane, said antenna comprising:

a planar monopole radiator, which is divided, as seen from a feed point of the antenna, into a first branch to form a lower operating band for the antenna, and a second branch to form an upper operating band for the antenna, wherein between said branches there remains a slot opening to an outer edge of the radiator, characterized in that said outer edge is the edge of the radiator running substantially in the direction of an end of the circuit board and outside the circuit board as seen from above, and wherein said slot opens to the outer edge in its central area to improve the omnidirectional radiation of the antenna on its upper operating band.

2. An antenna according to claim 1, characterized in that said radiator is located substantially in the same geometrical plane as the circuit board of the radio device.

3. An antenna according to claim 2, characterized in that said radiator is located at least partly on top of the ground plane.

4. An antenna according to claim 1, characterized in that said radiator is elevated from the circuit board of the radio device, partly on top of the ground plane.

5. An antenna according to claim 1, characterized in that it further comprises a radiating parasitic element located at least partly below said radiator and connected at one point thereof to the ground plane of at least one of the radio device or the signal ground.

6. An antenna according to claim 1, characterized in that the first branch has an end portion located in a central area of the radiator proximate the free end of the second branch so as to set said operating bands at the desired places in the frequency scale.

7. An antenna according to claim 1, characterized in that said radiator comprises a strip of metal sheet.

8. An antenna according to claim 1, characterized in that said slot opens to the outer edge of the radiator substantially perpendicularly to the end of the circuit board.

9. An antenna according to claim 1, characterized in that said slot opens to the outer edge of the radiator in the direction of the end of the circuit board.

10. An antenna for use in a radio device, the radio device having a circuit board comprising a ground plane, said antenna having improved omnidirectional radiation of in an upper operating band comprising:

a substantially planar monopole radiator, which comprises a first branch to form a lower operating band for the antenna, and a second branch to form said upper operating band for the antenna, between said branches being formed a slot opening to an outer edge of the radiator, said outer edge comprising an edge of the radiator running substantially in the direction of an end of the circuit board and outside at least a portion of the periphery of the circuit board;

wherein said slot opens to the outer edge in a central area of said radiator.

11. An antenna according to claim 10, wherein said radiator is located substantially in the same geometrical plane as the circuit board.

12. An antenna according to claim 11, wherein said radiator is located at least partly on top of the ground plane.

13. An antenna according to claim 10, wherein said radiator is elevated from the circuit board of the radio device, partly on top of the ground plane.

14. An antenna according to claim 10, further comprising a radiating parasitic element located at least partly below said radiator and connected at one point thereof to the ground plane of at least one of the radio device or the signal ground.

15. An antenna according to claim 10, wherein the first branch has an end portion located in a central area of the radiator proximate the free end of the second branch so as to set said operating bands at the desired places in the frequency scale.

16. An antenna according to claim 10, wherein said radiator comprises a strip of metal sheet.

17. An antenna according to claim 10, wherein said slot opens to the outer edge of the radiator substantially perpendicularly to the end of the circuit board.

18. An antenna according to claim 10, wherein said slot opens to the outer edge of the radiator in the direction of the end of the circuit board.

19. The antenna apparatus of claim 10, wherein said upper operating band comprises at least one Global System for Mobile Communication (GSM) band.

20. The antenna apparatus of claim 10, wherein said upper operating band comprises a global positioning system (GPS) band.

21. An antenna for use in a radio device, the radio device having a substrate means comprising a ground plane, said antenna having improved omnidirectional radiation of in an upper operating band comprising:

a substantially planar monopole radiator means, the radiator means comprising a first branch to form a lower operating band for the antenna, and a second branch to form said upper operating band for the antenna, between said branches being formed a slot opening to an outer edge of the radiator means, said outer edge comprising an edge of the radiator running substantially in the direction of an end of the substrate means and outside at least a portion of the periphery of the substrate means;

wherein said slot opens to the outer edge in a central area of said radiator means.

22. Antenna apparatus useful in a radio device comprising a substrate having a ground plane thereon, said antenna comprising:

a feed point;

a substantially planar monopole radiator comprising a first branch for a lower operating band of the antenna and a second branch for an upper operating band of the antenna;

a slot opening to an outer edge of the substantially planar monopole radiator, said slot opening being disposed in a generally centralized area of said radiator, said slot residing substantially between said first and second branches; and a tuning branch;

wherein said slot opening disposed in said generally centralized area improves the omnidirectional radiation characteristics of the antenna apparatus in at least one operating band.

23. The antenna apparatus of claim 22, wherein said outer edge is disposed substantially parallel with an end of the substrate.

24. The antenna apparatus of claim 23, wherein said generally centralized area comprises a 40-percent middle portion of said outer edge.

25. The antenna apparatus of claim 24, wherein said outer edge comprises a first and a second section at least partly demarcated by said slot opening, said first and second sections being substantially colinear with respect to one another.

26. The antenna apparatus of claim 25, wherein said first and second branches define a generally rectangular outer perimeter and a central aperture.

27. The antenna apparatus of claim 26, wherein at least one of said first and second branches protrudes into said central aperture forming a branch protrusion.

28. The antenna apparatus of claim 27, wherein said branch protrusion comprises a generally L-shaped branch section.

29. The antenna apparatus of claim 24, wherein said outer edge comprises a first and a second section at least partly demarcated by said slot opening, said first and second sections being substantially parallel, yet non-colinear, with respect to one another.

30. The antenna apparatus of claim 22, wherein said feed point is disposed proximate a region of intersection of said first and second branches.

31. The antenna apparatus of claim 22, wherein said first and second branches comprise differing lengths with respect to one another, said differing lengths corresponding to differing operating bands for said antenna apparatus.

32. The antenna apparatus of claim 22, wherein said at least one operating band comprises at least one Global System for Mobile Communication (GSM) band.

33. The antenna apparatus of claim 22, wherein said at least one operating band comprises a global positioning system (GPS) band.

34. Antenna apparatus useful in a radio device comprising a substrate having a ground plane thereon, said antenna comprising:

a feed point;

a substantially planar monopole radiator comprising a first branch for a lower operating band of the antenna and a second branch for an upper operating band of the antenna; and a slot opening to an outer edge of the substantially planar monopole radiator, said slot opening being disposed in a generally centralized area of said radiator, said slot residing substantially between said first and second branches;

wherein said slot opening disposed in said generally centralized area improves the omnidirectional radiation characteristics of the antenna apparatus in at least one operating band; and wherein at least one of said first and second branches protrudes into said central aperture forming a branch protrusion.

35. The antenna apparatus of claim 34, wherein said outer edge is disposed substantially parallel with an end of the substrate.

36. The antenna apparatus of claim 35, wherein said generally centralized area comprises a 40-percent middle portion of said outer edge.

37. The antenna apparatus of claim 36, wherein said outer edge comprises a first and a second section at least partly demarcated by said slot opening, said first and second sections being substantially colinear with respect to one another.

38. The antenna apparatus of claim 36, wherein said outer edge comprises a first and a second section at least partly demarcated by said slot opening, said first and second) sections being substantially parallel, yet non-colinear, with respect to one another.

39. The antenna apparatus of claim 35, wherein said feed point is disposed generally at a region of intersection of said first and second branches.

40. The antenna apparatus of claim 34, further comprising a tuning branch.

41. The antenna apparatus of claim 34, wherein said first and second branches define a generally rectangular outer perimeter and a central aperture.

42. The antenna apparatus of claim 34, wherein said branch protrusion comprises a generally L-shaped branch section.

43. The antenna apparatus of claim 34, wherein said first and second branches comprise differing lengths with respect to one another, said differing lengths corresponding to differing operating bands for said antenna apparatus.

44. The antenna apparatus of claim 34, wherein said at least one operating band is selected from the group consisting of: (i) a Global System for Mobile Communication (GSM) band; and (ii) a global positioning system (GPS) band.

45. Antenna apparatus useful in a radio device comprising a substrate having a) ground plane thereon, said antenna comprising:

a feed point;

a substantially planar monopole radiator comprising a first branch for a lower operating band of the antenna and a second branch for an upper operating band of the antenna; and a slot opening to an outer edge of the substantially planar monopole radiator, said slot opening being disposed in a generally centralized area of said radiator, said slot residing substantially between said first and second branches;

wherein said slot opening disposed in said generally centralized area improves the omnidirectional radiation characteristics of the antenna apparatus in at least one operating band; and wherein said outer edge comprises a first and a second section at least partly demarcated by said slot opening, said first and second sections being substantially parallel, yet non-collinear, with respect to one another.

46. The antenna apparatus of claim 45, wherein said outer edge is disposed substantially parallel with an end of the substrate.

47. The antenna apparatus of claim 46, wherein said generally centralized area comprises a 40-percent middle portion of said outer edge.

48. The antenna apparatus of claim 45, further comprising a tuning branch.

49. The antenna apparatus of claim 45, wherein said first and second branches define a generally rectangular outer perimeter and a central aperture, and at least one of said first and second branches protrudes into said central aperture forming a branch protrusion.

50. The antenna apparatus of claim 49, wherein said branch protrusion comprises a generally L-shaped branch section.

51. The antenna apparatus of claim 45, wherein said feed point is disposed proximate a region of intersection of said first and second branches.

52. The antenna apparatus of claim 45, wherein said first and second branches comprise differing lengths with respect to one another, said differing lengths corresponding to differing operating bands for said antenna apparatus.

53. The antenna apparatus of claim 45, wherein said at least one operating band is selected from the group consisting of: (i) a Global System for Mobile Communication (GSM) band; and (ii) a global positioning system (GPS) band.

* * * * *